US005784904A

United States Patent [19]

Youn

[11] Patent Number: 5,784,904

[45] Date of Patent: Jul. 28, 1998

[54] WASHING MACHINE WITH A COMPOUND PULSATOR HAVING A PLURALITY OF SUB-PULSATORS

[75] Inventor: Kab Jin Youn, Kwangju, Rep. of Korea

[73] Assignee: Daewoo Electronics Co., Ltd., Seoul, Rep. of Korea

[21] Appl. No.: 687,173

[22] Filed: Jul. 25, 1996

[30] Foreign Application Priority Data

Jul. 27, 1995 [KR] Rep. of Korea ..... 95 22378

[51] Int. Cl.[6] ..... D06F 13/02

[52] U.S. Cl. ..... 68/133; 68/134; 68/23.3

[58] Field of Search ..... 68/133, 134, 23.3; 134/188; 366/243, 241, 242, 343, 317, 329.1, 326.1, 326.2

[56] References Cited

U.S. PATENT DOCUMENTS

| | | | |
|---|---|---|---|
| 1,543,323 | 6/1925 | Dehle | 68/134 |
| 1,724,594 | 8/1929 | Huntington | 68/133 |
| 1,745,595 | 2/1930 | Altorfer | 68/133 |
| 1,810,047 | 6/1931 | Hersh | 68/134 |
| 1,834,936 | 12/1931 | Bryant | 68/133 |
| 2,142,961 | 1/1939 | Kuhn | 68/134 |
| 3,132,500 | 5/1964 | Bullcok | 68/134 |
| 3,285,040 | 11/1966 | Bochan | 68/134 |
| 3,381,504 | 5/1968 | Smith | 68/134 |
| 4,338,802 | 7/1982 | Ohmann et al. | 68/134 |
| 5,231,857 | 8/1993 | Rew et al. | 68/134 |

FOREIGN PATENT DOCUMENTS

| | | | |
|---|---|---|---|
| 60-53184 | 3/1985 | Japan | 68/134 |
| 60-174176 | 9/1985 | Japan | 68/134 |
| 62-201189 | 9/1987 | Japan | 68/134 |
| 63-89195 | 4/1988 | Japan | 68/133 |
| 64-11594 | 1/1989 | Japan | 68/134 |
| WO 93/13257 | 7/1933 | WIPO . | |

*Primary Examiner*—Frankie L. Stinson

*Attorney, Agent, or Firm*—Beveridge, DeGrandi, Weilacher & Young LLP

[57] ABSTRACT

A washing machine with a compound pulsator has a bottom sub-pulsator mounted on the bottom of the washing tub which is revolvable on the revolving shaft, a top sub-pulsator mounted on an upper part of the revolving shaft which is revolvable on the revolving shaft, an intermediate sub-pulsator mounted coaxially with the revolving shaft between the bottom sub-pulsator and the top sub-pulsator which is revolvable on the revolving shaft. The compound pulsator has a revolution controlling part in which the bottom sub-pulsator and the top sub-pulsator are revolved by a predetermined degree simultaneously with revolution of the revolving shaft, and then the intermediate sub-pulsator is engaged with the bottom sub-pulsator and the top sub-pulsator to be revolved therewith. Thereby, the sub-pulsators are alternately revolved in same direction and different directions, so that laundry articles can be prevented from tangling and thus efficiency of washing is largely improved.

20 Claims, 4 Drawing Sheets

WASHING MACHINE WITH A COMPOUND PULSATOR HAVING A PLURALITY OF SUB-PULSATORS

BACKGROUND OF THE INVENTION

1. Field of the Invention

The present invention relates to a washing machine, and more particularly to a washing machine with a compound pulsator having a plurality of sub-pulsators which laundry articles are washed while each of the sub-pulsators on one rotating shaft are rotated separately in order to prevent tangling and twisting of laundry articles and to improve efficiency of washing.

2. Prior Art

Generally, washing machines are classified into a vortex-type washing machine, a stirrer-type washing machine, and a drum-type washing machine according to the washing manner.

Among those washing machines, the vortex-type washing machine is provided with a pulsator rotatably mounted on the bottom of its washing tub. The pulsator is rotated by driving the motor. The rotation of the pulsator generates the vortex current of the washing water in the washing tub. The vortex current strikes the laundry articles, whereby they are rotated to be washed. The vortex-type washing machines are divided into one-tub-type washing machines and two-tub-type washing machines.

The stirrer-type washing machine is provided with a washing rod called an agitator which is disposed at the center of the washing tub. When the washing rod is regularly rotated, the water current is generated by the bladed washing rod, and the laundry articles make contact with the washing rod and the wall of the washing tub, thereby being washed.

Compared with the vortex-type washing machine, the stirrer-type washing machine is better in cleaning efficiency, causes less tangling of the laundry articles, and allows for a larger volume of laundry due to the bladed washing rod rotated at its center, whereas in the vortex-type washing machine, the contact area between the laundry and the washing tub is increased so that clothes of the laundry can be damaged, and it is improper to wash a massive laundry article due to the washing rod.

The drum-type washing machine is provided with a cylindrical drum having a plurality of washing water communication holes inside the stationary tub. The cylindrical drum is so disposed that its revolving shaft in a longitudinal direction is parallel to the surface of the washing water in the stationary tub. When washing, this drum revolves on the revolving shaft of longitudinal direction, and the laundry articles revolve about the revolving shaft hanging on projections formed on the inner surface of the cylindrical drum, thereby they become washed. The drum-type washer is the proper one for washing a large volume of laundry articles.

Among the above-mentioned washing machines, the vortex-type washer is generally used for domestic use, and recently, an automatic washer, one-tub-type washer in which washing and dehydration are carried out in the same tub, has been commonly used.

Hereinafter, the conventional one-tub-type washer of the vortex-type washing machine will be described in detail with reference to FIG. 1.

FIG. 1 is a schematic cross-sectional view of a one-tub type washing machine having a pulsator according to the prior art.

As shown in FIG. 1, reference numeral 10 denotes a stationary washer tub, in which a revolving shaft 60 is upwardly installed at the center of the bottom thereof, and a washing tub 20 is connected with revolving shaft 60. Washing tub 20 has a plurality of washing water communication holes. A pulsator 30 is revolvably placed on the bottom of the washing tub 20 for generating a vortex current. A driving part 40 having a motor 41 and clutch assembly 43 is installed at the predetermined position of the lower part of the outside of stationary tub 10 in order to drive washing tub 20 and pulsator 30.

The washing water received in stationary tub 10 is revolved by revolution of pulsator 30, thereby the laundry articles become washed.

The revolution of the above-mentioned conventional pulsator 30 generates a heart-shaped vortex current which rises along the wall of washing tub 20 and then falls toward the center of washing tub. Washing by the vortex current is good in cleaning efficiency. However, since the current forms a circle in the horizontal plane, the laundry articles become tangled and twisted with each other. Therefore, there is a problem that the clothes are easily damaged when washing thin and soft clothes.

SUMMARY OF THE INVENTION

The present invention has been made to overcome the above-described problems of the prior art, and accordingly it is an object of the present invention to provide a washing machine with a compound pulsator having a plurality of sub-pulsators in which laundry articles are washed while each of the sub-pulsators on one revolving shaft are revolved separately in order to prevent tangling and twisting of laundry articles and to improve efficiency of washing.

To achieve the above object, the present invention provides a washing machine with a compound pulsator having a plurality of sub-pulsators comprising:

a stationary tub for receiving washing water when washing; a revolving shaft disposed at the center of the bottom of the stationary tub;

a washing tub coaxially connected with the stationary tub, the washing tub being revolvable on the revolving shaft and having a plurality of washing water communication holes;

a compound pulsator having a bottom sub-pulsator mounted on the bottom of the washing tub which is revolvable on the revolving shaft, a top sub-pulsator mounted on an upper part of the revolving shaft which is revolvable on the revolving shaft, an intermediate sub-pulsator mounted coaxially with the revolving shaft between the bottom sub-pulsator and the top sub-pulsator which is revolvable on the revolving shaft.

In the washing machine with a compound pulsator having a plurality of sub-pulsators, the compound sub-pulsator further comprises a revolution controlling part which the bottom sub-pulsator and the top sub-pulsator are revolved by a predetermined degree simultaneously with revolution of the revolving shaft, and then the intermediate sub-pulsator is engaged with the bottom sub-pulsator and the top sub-pulsator to be revolved therewith, so that the intermediate sub-pulsator begins to be revolved in a certain time interval after the bottom sub-pulsator and the top sub-pulsator begin to be revolved.

In the washing machine with a compound pulsator having a plurality of sub-pulsators, the bottom sub-pulsator is fixed with the revolving axis to be integrally revolved therewith. The bottom sub-pulsator has a main body of a round plate shape having a groove which is formed at a center portion of upper surface of the main body, and in which a lower part of the intermediate sub-pulsator is to be inserted. The bottom sub-pulsator has the main body having a plurality of ribs formed on an upper surface thereof and a plurality of communication holes through which washing fluid flows freely.

In the washing machine with a compound pulsator having a plurality of sub-pulsators, the top sub-pulsator is fixed with a top of the revolving axis to be integrally revolved therewith. The top sub-pulsator has a cylindrical shape of which a lower part is open so that an upper part of the intermediate sub-pulsator is inserted thereinto. The top sub-pulsator has a plurality of ribs formed on an upper surface thereof.

The upper part of the intermediate sub-pulsator is inserted into the top sub-pulsator in the revolvable state on the revolving axis to be integrally revolved therewith. The inserted intermediate sub-pulsator has a first projector formed on an outer-circumference thereof and the top sub-pulsator has a first prime projector formed on an inner-circumference thereof, and the first and first prime projectors serve as revolution controlling parts. Thereby, after the top sub-pulsator is revolved by a predetermined degree integrally with the revolving shaft regardless of revolution of the intermediate sub-pulsator, the first and first prime projectors are engaged with each other, and therefore the intermediate sub-pulsator is continuously revolved.

The lower part of the intermediate sub-pulsator is inserted into the bottom sub-pulsator in the revolvable state on the revolving axis to be integrally revolved therewith. The inserted intermediate sub-pulsator has a second projector formed on an outer-circumference thereof and the bottom sub-pulsator has a first prime projector formed on an inner-circumference thereof, and the second and second prime projectors serve as revolution controlling parts. Thereby, after the bottom sub-pulsator is revolved by a predetermined degree integrally with the revolving shaft regardless of revolution of the intermediate sub-pulsator, the second and second prime projectors are engaged with each other, and therefore the intermediate sub-pulsator is succeedingly revolved.

Moreover, the sub-pulsators of the compound pulsator are closely positioned to each other.

According to the washing machine with a compound pulsator having a plurality of sub-pulsators of the present invention constructed as described above, in a washing operation, the intermediate sub-pulsator has its revolving direction changed at a predetermined time interval after the bottom and top sub-pulsators have their revolving directions changed, so that a whirling water current in the washing tub can be broken while sub-pulsators are revolved in different direction. Therefore, this can prevent the laundry articles from tangling and twisting with each other when washing. Also the efficiency of washing is largely improved.

Moreover, according to the washing machine with a compound pulsator having a plurality of sub-pulsators of the present invention constructed as described above, in a washing operation, the intermediate sub-pulsator has its revolving direction changed at a predetermined time interval after the bottom and top sub-pulsators have their revolving directions changed, so that the succeeding whirling water current generated by the intermediate sub-pulsator is added to the whirling water current generated by the bottom and top sub-pulsators. Therefore, the clockwise or counterclockwise current of the washing water becomes stronger, and thus efficiency of washing is largely improved.

BRIEF DESCRIPTION OF THE DRAWINGS

The above objects and other advantages of the present invention will become more apparent by describing in detail preferred embodiments thereof with reference to the attached drawings in which.

DESCRIPTION OF THE PREFERRED EMBODIMENTS

Hereinafter, the present invention will be described in detail with reference to the accompanying drawings.

Figure 1:
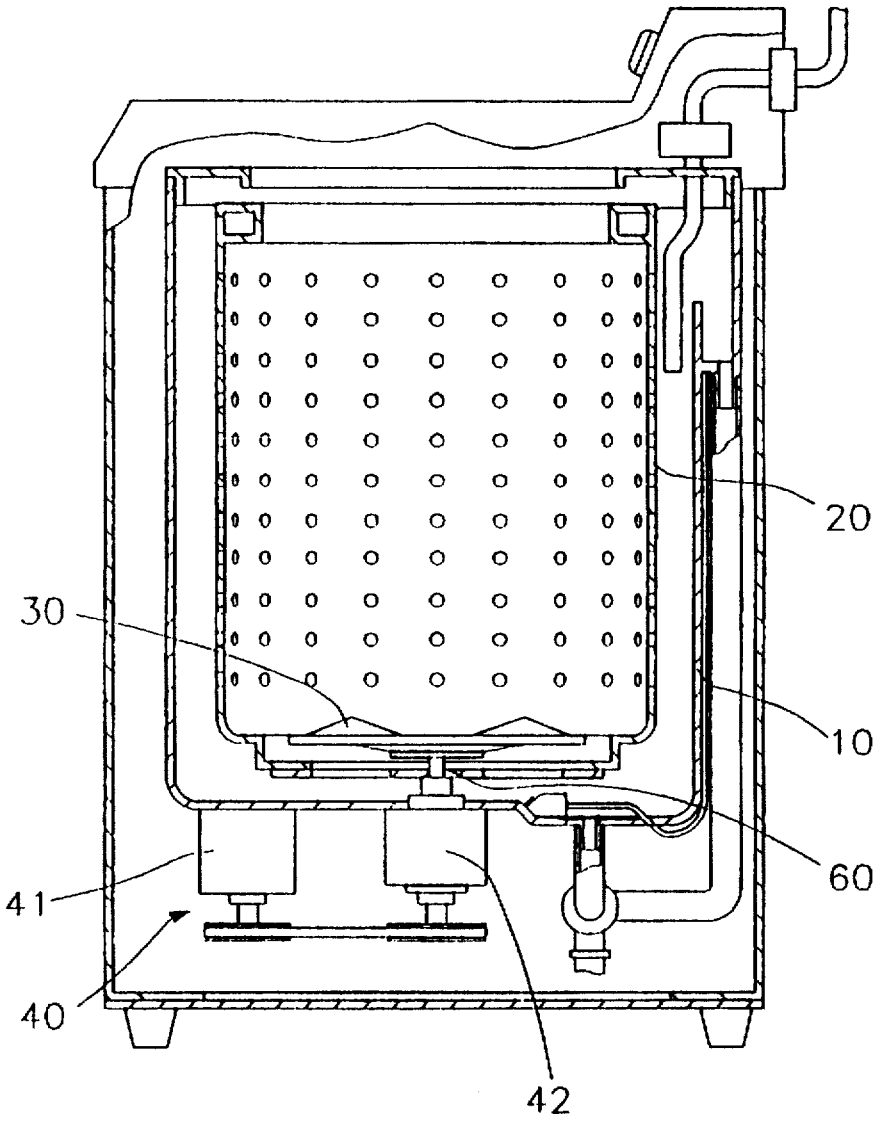
FIG. 1 PRIOR ART
FIG. 1 is a schematic cross-sectional view of a one-tub type washing machine having a pulsator according to the prior art.
Figure 2:
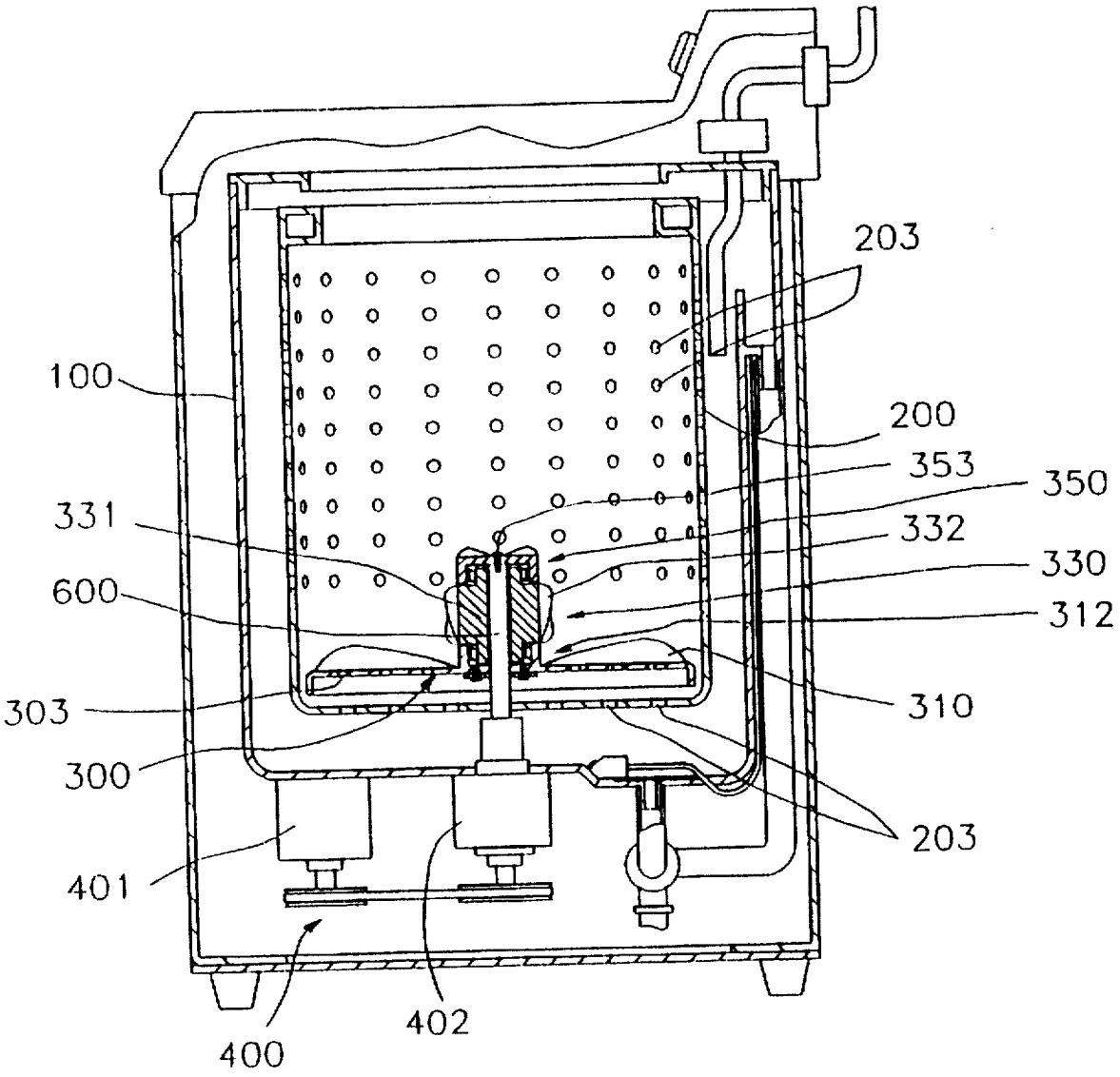
FIG. 2 is a schematic cross-sectional view of a one-tub type washing machine having a compound pulsator according to the present invention.
Figure 3:
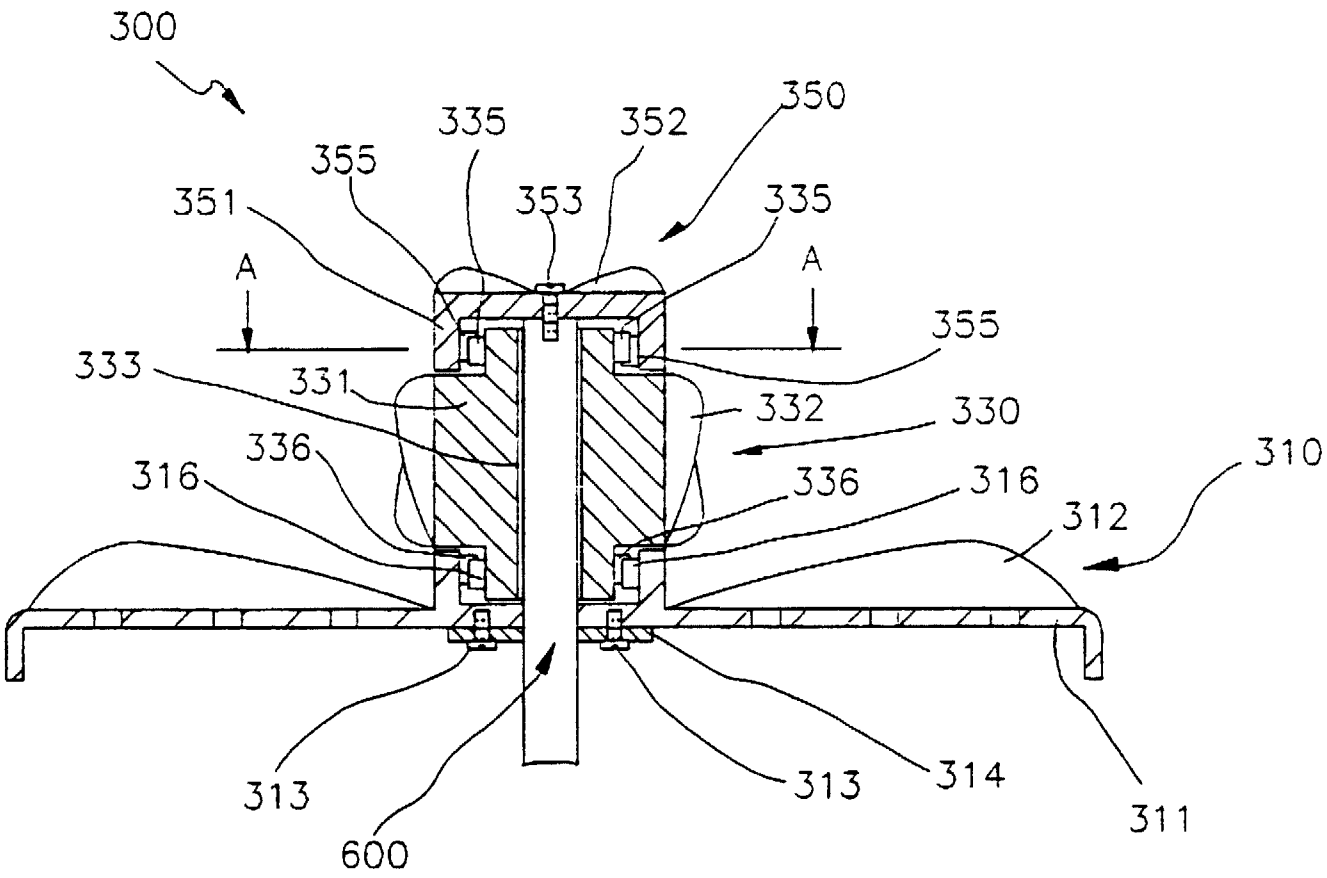
FIG. 3 is an exploded and enlarged perspective view of the pulsator in the washing machine of FIG. 2.
Figure 4:
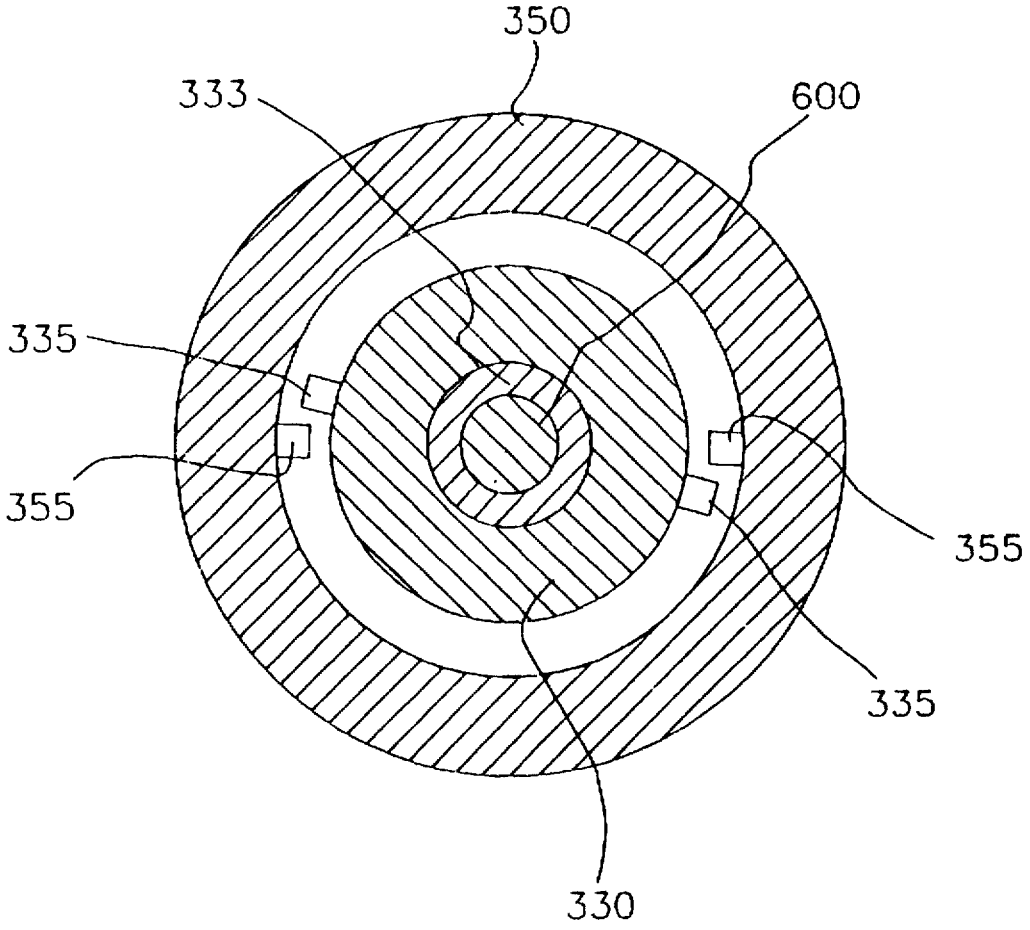
FIG. 4 is an cross-sectional view taken along line A—A in the washing machine of FIG. 2.

FIG. 2 is a schematic cross-sectional view of a one-tub type washing machine having a compound pulsator according to the present invention. FIG. 3 is an exploded and enlarged perspective view of the pulsator in the washing machine of FIG. 2, and FIG. 4 is an cross-sectional view taken along line A—A in the washing machine of FIG. 2.

As shown in FIGS. 2 and 3, reference numeral 100 denotes a stationary tub for receiving washing water. A revolving shaft 600 is installed upwardly at the center of the bottom thereof.

A washing tub 200 has a plurality of washing water communication holes 203, being deposited in stationary tub 100, and being revolvable on revolving shaft 600 coaxially with stationary tub 100.

A compound pulsator 300 is mounted on the bottom of washing tub 200 in the washing tub in a revolvable state on revolving shaft 600.

Compound pulsator 300 has a bottom sub-pulsator 310, a intermediate sub-pulsator 330, and a top sub-pulsator 350. Bottom sub-pulsator 310 is mounted on the bottom of the washing tub 200 which is revolvable on the revolving shaft 600. Top sub-pulsator 350 is mounted on an upper part of the revolving shaft 600 which is revolvable on the revolving shaft 600. Intermediate sub-pulsator 330 is mounted coaxially with the revolving shaft 600 between bottom sub-pulsator 310 and top sub-pulsator 350.

Bottom sub-pulsator 310 has a through tunnel formed through a central portion thereof, which the revolving shaft is to be inserted through. Thus, bottom sub-pulsator 310 is installed on the bottom of washing tub 200 as the revolving shaft 600 is inserted through bottom sub-pulsator 310. Under the bottom sub-pulsator 310 is formed a round plate for locking 314 stuck to the revolving shaft 600. The round plate for locking 314 and the bottom sub-pulsator 310 are coupled by screws 313 to be integrally revolved with the revolving shaft 600. The bottom sub-pulsator 310 has a main body 311 of a round plate shape. The main body 311 has a cylindrical groove formed at the central part of its upper surface into which the lower part of intermediate sub-pulsator 330 is to be inserted. The bottom sub-pulsator 310 has a plurality of ribs 302 radially formed at the peripheral portion of the upper surface of main body 311 thereof. The main body 311 has a plurality of communication holes 318 through which washing fluid flows freely.

The central top of top sub-pulsator 350 and the top of revolving shaft 600 are coupled by a screw 353 to be integrally revolved with the revolving shaft 600. Thus, the top sub-pulsator 350 is also stuck to the revolving shaft 600 to be integrally revolved with the revolving shaft 600. The top sub-pulsator 350 has a main body 351 of a cylindrical shape with its lower part open so that the upper part of intermediate sub-pulsator 330 can be inserted into the lower part of top sub-pulsator 350. Top sub-pulsator 350 has a plurality of ribs 352 radially formed at its upper surface. Pulsator 300 has guide projections 301 formed on an outer side of the round plate shaped main body 310, guide projections 301 being guided along spiral guide groove 201 of washing tub 200. Pulsator 200 has second axial grooves 305 which are spline-engaged with first axial grooves 605 and formed on the inner side of its main body 310. In the revolution of revolving shaft 600, pulsator 300 is revolved. Simultaneously with its revolution, pulsator 300 is moved upward or downward.

The intermediate sub-pulsator 330 has a main body 351 of a roughly cylindrical shape, and has a cylindrical through tunnel formed through a central portion thereof so that the revolving shaft can be inserted therethrough. Thus, intermediate sub-pulsator 330 is installed between the bottom sub-pulsator 310 and the top sub-pulsator 350 as the revolving shaft 600 is inserted through intermediate sub-pulsator 330. A metallic bearing 333 is formed between the inner-circumference of intermediate sub-pulsator 330 with the cylindrical through tunnel and the revolving shaft 600, so that intermediate sub-pulsator 330 is smoothly revolved on the revolving shaft 600. The intermediate sub-pulsator 330 has a plurality of ribs 332 formed on its outer-circumferential surface of the cylindrical main body 331.

The upper part of the intermediate sub-pulsator 330 is inserted into the top sub-pulsator 350 in the revolvable state on the revolving axis 600 to be integrally revolved therewith. The inserted intermediate sub-pulsator 330 has one or more first projectors 335 formed on an outer-circumference thereof and the top sub-pulsator 350 has one or more first prime projectors 355 formed on an inner-circumference thereof, and the first and first prime projectors 335 and 355 serve as revolution controlling parts. Thereby, after the top sub-pulsator 350 is revolved by a predetermined degree integrally with the revolving shaft 600 regardless of revolution of the intermediate sub-pulsator 330, the first and first prime projectors 335 and 355 are engaged with each other, and therefore the intermediate sub-pulsator 330 is continuously revolved with top sub-pulsator 350.

Similarly, the lower part of the intermediate sub-pulsator 330 is inserted into the bottom sub-pulsator 310 in the revolvable state on the revolving axis 600 to be integrally revolved therewith. The inserted intermediate sub-pulsator 330 has one or more second projectors 336 formed on an outer-circumference thereof and the bottom sub-pulsator 310 has one or more second prime projectors 316 formed on an inner-circumference thereof, and the second and second prime projectors 336 and 316 serve as revolution controlling parts. Thereby, after the bottom sub-pulsator 310 is revolved by a predetermined degree integrally with the revolving shaft 600 regardless of revolution of the intermediate sub-pulsator 330, the second and second prime projectors 336 and 316 are engaged with each other, and therefore the intermediate sub-pulsator is succeedingly revolved with bottom sub-pulsator 310.

The first projector 335 and the second projector 336 of the intermediate sub-pulsator 330 are aligned on a straight line, the first prime projector 355 of the top sub-pulsator 350 and the second prime projector 316 of the bottom sub-pulsator 310 are aligned on a straight line. An engaging operation of the first projector 335 and the first prime projector 315 and an engaging operation of the second projector 336 and the second prime projector 316 are generated at the same time.

The sub-pulsators 310, 330, 350 of the compound pulsator are closely positioned to each other.

Hereinbelow, the operation of the washing machine with a compound pulsator having a plurality of sub-pulsators according to the present invention constructed as above will be described.

In the event of washing operation, a driving part 400 is driven in the state that the washing water is received by the desired amount in stationary tub 100. Revolving shaft 600 installed at the center of the bottom of stationary tub 100 is revolved by driving the driving part 400.

The bottom sub-pulsator 310 and the top sub-pulsator 350 are revolved integrally with revolving shaft 600 which are screw-coupled with the bottom sub-pulsator 310 and the top sub-pulsator 350.

After the top sub-pulsator 350 and the bottom sub-pulsator 310 are revolved by a predetermined degree integrally with the revolving shaft 600 regardless of revolution of the intermediate sub-pulsator 330, the first and first prime projectors 335 and 355 meet each other and the second and second prime projectors 336 and 316 meet each other, and therefore the intermediate sub-pulsator 330 is engaged with the top and bottom sub-pulsators 350 and 310 to be revolved therewith.

Thus, the swirling currents are respectively generated at the upper part and the lower part of the washing tub 200 due to revolutions of the top and the bottom sub-pulsator 350 and 310. At a predetermined time interval after the sub-pulsators are revolved, the intermediate sub-pulsator 330 is revolved. The revolution of the intermediate sub-pulsator 330 picks up the speed of the originally swirling current generated by bottom and top sub-pulsators 310 and 350, and thus efficiency of washing is largely improved.

Subsequently, the revolving shaft 600 has its revolving direction changed, and at the same time, the bottom and top sub-pulsators also have their revolving directions changed.

At this time, the intermediate sub-pulsator 330 is still revolved in the original revolving direction while the bottom and top sub-pulsators 310 and 350 have their revolving directions changed to be inversely revolved integrally with revolving shaft 600 during a certain time, so that a whirling water current in the washing tub can be quite broken.

After a while, the first and first prime projectors 335 and 355 are engaged with each other, and the second and second prime projectors 336 and 316 are engaged with each other, and therefore the intermediate sub-pulsator 330 is engaged with the top and the bottom sub-pulsators 350 and 310 to be revolved in the inverse direction together.

Thus, the inversely swirling currents are respectively generated at the upper part and the lower part of the washing tub 200 due to inverse revolution of the top and bottom sub-pulsator 350 and 310. At a predetermined time interval after the sub-pulsators are inversely revolved, the intermediate sub-pulsator 330 is inversely revolved, and the above-mentioned operations are repeatedly carried out.

According to the washing machine of the present invention constructed as described above, there is provided a revolution controlling part wherein, in a washing operation, at a predetermined time interval after the revolving shaft is revolved, and at the same time, the bottom and top sub-pulsators are revolved integrally with the revolving shaft, the intermediate sub-pulsator can be revolved with the top and bottom sub-pulsators. Thereby, the bottom and top sub-pulsators and the intermediate sub-pulsator are alternately revolved in same direction and different directions.

Therefore, this can prevent the laundry articles from tangling and twisting with each other when washing, and also efficiency of washing is largely improved.

That is to say, since the sub-pulsators are revolved in different directions, a washing operation is performed by random and irregular currents which are generated by collision of the water currents in different directions. Therefore, laundry articles can be prevented from tangling and twisting with each other when washing. In addition, during washing, since the laundry articles are struck by washing water in random directions, laundry articles can be washed with an effect in which the laundry is rubbed and beaten in various directions. As a result, efficiency of washing is largely improved.

Furthermore, according to the washing machine with a compound pulsator of the present invention constructed as described above, in a washing operation, the intermediate sub-pulsator has its revolving direction changed in a predetermined time interval after the bottom and top sub-pulsators have their revolving directions changed, so that the succeeding whirling water current generated by the intermediate sub-pulsator is added to the whirling water current generated by the bottom and top sub-pulsators. Therefore, the clockwise or counterclockwise current of the washing water becomes stronger, and thus efficiency of washing is largely improved.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A washing machine with a compound pulsator having a plurality of sub-pulsators comprising:

a stationary tub for receiving washing water when washing;

a revolving shaft disposed at the center of the bottom of the stationary tub;

a washing tub coaxially connected with the stationary tub, the washing tub being revolvable on the revolving shaft and having a plurality of washing water communication holes;

a compound pulsator having a bottom sub-pulsator mounted on the bottom of the washing tub which is revolvable on the revolving shaft, a top sub-pulsator mounted on an upper part of the revolving shaft which is revolvable on the revolving shaft, an intermediate sub-pulsator mounted coaxially with the revolving shaft between the bottom sub-pulsator and the top sub-pulsator which is revolvable on the revolving shaft, wherein the compound pulsator has a revolution controlling part in which the bottom sub-pulsator and the top sub-pulsator are revolved by a predetermined degree simultaneously with revolution of the revolving shaft, and then the intermediate sub-pulsator is engaged with the bottom sub-pulsator and the top sub-pulsator to be revolved therewith, so that the intermediate sub-pulsator begins to be revolved at a certain time interval after the bottom sub-pulsator and the top sub-pulsator begin to be revolved.

2. A washing machine as claimed in claim 1, wherein the bottom sub-pulsator is fixed with the revolving axis to be integrally revolved therewith.

3. A washing machine as claimed in claim 1, wherein the bottom sub-pulsator has a main body of a round plate shape having a groove which is formed at a center portion of the upper surface of the main body, and in which a lower part of the intermediate sub-pulsator is to be inserted.

4. A washing machine as claimed in claim 3, wherein the bottom sub-pulsator has the main body having a plurality of ribs formed on the upper surface thereof.

5. A washing machine as claimed in claim 3, wherein the bottom sub-pulsator has a plurality of communication holes through which washing fluid flows freely.

6. A washing machine as claimed in claim 1, wherein the top sub-pulsator is fixed with a top of the revolving axis to be integrally revolved therewith.

7. A washing machine as claimed in claim 1, wherein the top sub-pulsator has a cylindrical shape of which a lower part is open so that an upper part of the intermediate sub-pulsator is inserted thereinto.

8. A washing machine as claimed in claim 1, wherein the top sub-pulsator has a plurality of ribs formed on an upper surface thereof.

9. A washing machine as claimed in claim 1, wherein the intermediate sub-pulsator has a main body of a roughly cylindrical shape, and has a cylindrical through tunnel formed through a central portion thereof so that the revolving shaft can be inserted therethrough.

10. A washing machine as claimed in claim 9, wherein the intermediate sub-pulsator has a metallic bearing formed between an inner-circumference of intermediate sub-pulsator with the cylindrical through tunnel and the revolving shaft, so that the intermediate sub-pulsator is smoothly revolved on the revolving shaft.

11. A washing machine as claimed in claim 1, wherein the intermediate sub-pulsator has a plurality of ribs formed on an outer-circumferential surface of a cylindrical main body thereof.

12. A washing machine as claimed in claim 1, wherein the revolution controlling part comprises one or more first projectors formed on an outer-circumference of the intermediate sub-pulsator and one or more first prime projector formed on an inner-circumference of the top sub-pulsator.

13. A washing machine as claimed in claim 12, wherein the upper part of the intermediate sub-pulsator is inserted into the top sub-pulsator in the revolvable state on the revolving axis, so that, after the top sub-pulsator is revolved by a predetermined degree integrally with the revolving shaft regardless of revolution of the intermediate sub-pulsator, the first and first prime projectors are engaged with each other, and thereby the intermediate sub-pulsator is engaged with the top sub-pulsator to be revolved therewith.

14. A washing machine as claimed in claim 1, wherein the revolution controlling part comprises one or more second projectors formed on an outer-circumference of the intermediate sub-pulsator and one or more second prime projector formed on an inner-circumference of the bottom sub-pulsator.

15. A washing machine as claimed in claim 14, wherein the lower part of the intermediate sub-pulsator is inserted into the bottom sub-pulsator in the revolvable state on the revolving axis, so that, after the bottom sub-pulsator is revolved by a predetermined degree integrally with the revolving shaft regardless of revolution of the intermediate sub-pulsator, the second and second prime projectors are engaged with each other, and thereby the intermediate sub-pulsator is engaged with the bottom sub-pulsator to be revolved therewith.

16. A washing machine as claimed in claim 1, wherein the sub-pulsators of the compound pulsator are closely positioned each other.

17. A washing machine with a compound pulsator having a plurality of sub-pulsators comprising:

a stationary tub for receiving washing water when washing;

a revolving shaft disposed at the center of the bottom of the stationary tub;

a washing tub coaxially connected with the stationary tub, the washing tub being revolvable on the revolving shaft and having a plurality of washing water communication holes; and a compound pulsator having a bottom sub-pulsator mounted on the bottom of the washing tub which is revolvable on the revolving shaft, a top sub-pulsator mounted on an upper part of the revolving shaft which is revolvable on the revolving shaft, an intermediate sub-pulsator mounted coaxially with the revolving shaft between the bottom sub-pulsator and the top sub-pulsator which is revolvable on the revolving shaft, and a revolution controlling part having one or more first projectors formed on an outer-circumference of the intermediate sub-pulsator and one or more first prime projector formed on an inner-circumference of the top sub-pulsator, wherein the upper part of the intermediate sub-pulsator is inserted into the top sub-pulsator in the revolvable state on the revolving axis, so that, after the top sub-pulsator is revolved by a predetermined degree integrally with the revolving shaft regardless of revolution of the intermediate sub-pulsator, the first and first prime projectors are engaged with each other, and thereby the intermediate sub-pulsator is engaged with the top sub-pulsator to be revolved therewith.

18. A washing machine with a compound pulsator having a plurality of sub-pulsators comprising:

a stationary tub for receiving washing water when washing;

a revolving shaft disposed at the center of the bottom of the stationary tub;

a washing tub coaxially connected with the stationary tub, the washing tub being revolvable on the revolving shaft and having a plurality of washing water communication holes; and a compound pulsator having a bottom sub-pulsator mounted on the bottom of the washing tub which is revolvable on the revolving shaft, a top sub-pulsator mounted on an upper part of the revolving shaft which is revolvable on the revolving shaft, an intermediate sub-pulsator mounted coaxially with the revolving shaft between the bottom sub-pulsator and the top sub-pulsator which is revolvable on the revolving shaft, and a revolution controlling part having one or more second projectors formed on an outer-circumference of the intermediate sub-pulsator and one or more second prime projector formed on an inner-circumference of the bottom sub-pulsator, wherein the lower part of the intermediate sub-pulsator is inserted into the bottom sub-pulsator in the revolvable state on the revolving axis, so that, after the bottom sub-pulsator is revolved by a predetermined degree integrally with the revolving shaft regardless of revolution of the intermediate sub-pulsator, the second and second prime projectors are engaged with each other, and thereby the intermediate sub-pulsator is engaged with the bottom sub-pulsator to be revolved therewith.

19. A washing machine with a compound pulsator having a plurality of sub-pulsators comprising:

a stationary tub for receiving washing water when washing;

a revolving shaft disposed at the center of the bottom of the stationary tub;

a washing tub coaxially connected with the stationary tub, the washing tub being revolvable on the revolving shaft and having a plurality of washing water communication holes; and a compound pulsator having a bottom sub-pulsator mounted on the bottom of the washing tub which is revolvable on the revolving shaft, a top sub-pulsator mounted on an upper part of the revolving shaft which is revolvable on the revolving shaft, an intermediate sub-pulsator mounted coaxially with the revolving shaft between the bottom sub-pulsator and the top sub-pulsator which is revolvable on the revolving shaft, and a revolution controlling part having one or more first projectors formed on an outer-circumference of the intermediate sub-pulsator, one or more first prime projector formed on an inner-circumference of the top sub-pulsator, one or more second projectors formed on an outer-circumference of the intermediate sub-pulsator, and one or more second prime projector formed on an inner-circumference of the bottom sub-pulsator, wherein the first and second projectors are aligned on a straight line, and the first prime and second prime projectors are aligned on a straight line, wherein, the upper part of the intermediate sub-pulsator is inserted into the top sub-pulsator in the revolvable state on the revolving axis, and the lower part of the intermediate sub-pulsator is inserted into the bottom sub-pulsator in the revolvable state on the revolving axis, so that, after the top and bottom sub-pulsator are revolved by a predetermined degree integrally with the revolving shaft regardless of revolution of the intermediate sub-pulsator, the first and first prime projectors and the second and second prime projectors are respectively engaged with each other, and thereby the intermediate sub-pulsator is engaged with the top and bottom sub-pulsators to be revolved therewith.

20. A washing machine with a compound pulsator having a plurality of sub-pulsators comprising:

a stationary tub for receiving washing water when washing;

a revolving shaft disposed at the center of the bottom of the stationary tub;

a washing tub coaxially connected with the stationary tub, the washing tub being revolvable on the revolving shaft and having a plurality of washing water communication holes;

a compound pulsator having a bottom sub-pulsator mounted on the bottom of the washing tub which is revolvable on the revolving shaft, a top sub-pulsator mounted on an upper part of the revolving shaft which is revolvable on the revolving shaft, an intermediate sub-pulsator mounted coaxially with the revolving shaft between the bottom sub-pulsator and the top sub-pulsator which is revolvable on the revolving shaft, said intermediate sub-pulsator having a main body of a roughly cylindrical shape with a cylindrical through tunnel formed through a central portion thereof so that the revolving shaft can be inserted therethrough, wherein the intermediate sub-pulsator has a metallic bearing formed between an inner-circumference of intermediate sub-pulsator with the cylindrical through tunnel and the revolving shaft, so that the intermediate sub-pulsator is smoothly revolved on the revolving shaft, and the intermediate sub-pulsator has a plurality of ribs formed on an outer-circumferential surface of a cylindrical main body thereof.

* * * * *